US008579024B2

(12) United States Patent
Mailand et al.

(10) Patent No.: US 8,579,024 B2
(45) **Date of Patent: *Nov. 12, 2013**

(54) NON-DAMAGING SLIPS AND DRILLABLE BRIDGE PLUG

(75) Inventors: Jason C. Mailand, The Woodlands, TX (US); Glenn A. Bahr, The Woodlands, TX (US)

(73) Assignee: Team Oil Tools, LP, The Woodlands, TX (US)

( * ) Notice: Subject to any disclaimer, the term of this patent is extended or adjusted under 35 U.S.C. 154(b) by 497 days.

This patent is subject to a terminal disclaimer.

(21) Appl. No.: 12/836,333

(22) Filed: Jul. 14, 2010

(65) Prior Publication Data

US 2010/0276159 A1 Nov. 4, 2010

(51) Int. Cl.
*E21B 23/00* (2006.01)

(52) U.S. Cl.
USPC ..... 166/138; 166/216; 166/118

(58) Field of Classification Search
USPC ..... 166/118, 138, 216, 217
See application file for complete search history.

(56) References Cited

U.S. PATENT DOCUMENTS

| | | | | |
|---|---|---|---|---|
| 3,746,093 | A * | 7/1973 | Mullins | 166/217 |
| 4,901,794 | A | 2/1990 | Baugh et al. | |
| 5,701,959 | A * | 12/1997 | Hushbeck et al. | 166/387 |
| 5,984,007 | A * | 11/1999 | Yuan et al. | 166/134 |
| 6,581,681 | B1 | 6/2003 | Zimmerman et al. | |
| 6,695,050 | B2 * | 2/2004 | Winslow et al. | 166/118 |
| 6,712,153 | B2 * | 3/2004 | Turley et al. | 166/387 |
| 6,793,022 | B2 * | 9/2004 | Vick et al. | 166/382 |
| 6,796,376 | B2 | 9/2004 | Frazier | |
| 7,048,065 | B2 | 5/2006 | Badrak et al. | |
| 7,096,938 | B2 * | 8/2006 | Carmody et al. | 166/134 |
| 7,614,448 | B2 | 11/2009 | Swagerty et al. | |
| 7,980,300 | B2 * | 7/2011 | Roberts et al. | 166/118 |
| 2003/0188876 | A1 * | 10/2003 | Vick et al. | 166/382 |
| 2005/0189103 | A1 * | 9/2005 | Roberts et al. | 166/134 |
| 2006/0272828 | A1 * | 12/2006 | Manson | 166/387 |
| 2008/0135261 | A1 | 6/2008 | McGilvray et al. | |
| 2008/0190600 | A1 | 8/2008 | Shkurti et al. | |
| 2008/0264627 | A1 * | 10/2008 | Roberts et al. | 166/118 |
| 2008/0308266 | A1 * | 12/2008 | Roberts et al. | 166/118 |
| 2009/0065192 | A1 * | 3/2009 | Lucas | 166/119 |
| 2009/0205843 | A1 * | 8/2009 | Gandikota et al. | 166/118 |
| 2010/0132960 | A1 | 6/2010 | Shkurti et al. | |
| 2010/0263857 | A1 * | 10/2010 | Frazier | 166/118 |

* cited by examiner

*Primary Examiner* — Frederick L Lagman
(74) *Attorney, Agent, or Firm* — Lee, Jorgensen, Pyle & Kewalramani, P.C.

(57) ABSTRACT

A non-damaging slip assembly includes slips having grit on a smooth surface, the slips preferably made from a ductile material, such that the slips do not cause damage to the wall of a tubular when the slips are set. The slips fail under tensile force during setting. The cone used to expand the slips may have slits that narrow during setting of the slips. The slip assembly may be used to anchor a variety or devices inside a tubular. A drillable, non-damaging bridge plug using the non-damaging slip assembly has a threaded mandrel holding the cone by threads inside the cone. When the slips are set, the slits in the cone narrow such that threads in the cone do not allow rotation of the slips as they are drilled. The bridge plug can be drilled by a PDC bit without damaging the tubular.

19 Claims, 5 Drawing Sheets

NON-DAMAGING SLIPS AND DRILLABLE BRIDGE PLUG

BACKGROUND OF INVENTION

1. Field of the Invention

This invention relates to a slip assembly that can be used to press against the inside wall of a tubular to anchor a tool in the tubular without significantly deforming or damaging the wall, even at high anchoring force, and the use of the slip assembly in a bridge plug or other device to be anchored in a tubular.

2. Description of Related Art

Slips are any self-gripping device consisting of three or more wedges that are held together and form a near circle either (1) around an object to be supported by contact with surfaces of the slips or (2) within a tubular to anchor an object within the tubular. The first type of slips is normally used to grip a drill string, wire line or other cylindrical devices suspended in a well. The second type of slips is used to anchor bridge plugs, frac plugs, cement retainers and other devices temporarily or permanently placed at a selected location within tubulars. Normally, the slips are fitted with replaceable, hardened tool steel teeth that embed into the outside or inside surface of the tubular.

The embedment of the hardened steel teeth of slips causes permanent damage to the outside or inside surface of tubulars. Linear or non-linear notches may be formed that can cause stress concentration in the tubular wall. Under some conditions the damage is inconsequential, but under other conditions, such as when high-strength or corrosion-resistant pipe is used, the damage may lead to stress cracking or stress failure of the tubular.

A slip assembly consists of slips and a cone to displace the slips either radially inward (first type of slip assembly) or radially outward (second type of slip assembly). In the second type of slip assembly, a cone slides along the inside surface of the slips, pressing them radially outward, as the cone moves axially along a mandrel within the slips. The applications of slip assemblies disclosed herein use the second type of slip assembly.

One of the applications of the second type of slip assembly is a bridge plug or a special type of bridge plug called a "frac plug." The bridge plug may be set in the casing of a well by wireline, coiled tubing or conventional pipe. The plug is often set by attaching it to a wireline setting tool. The setting tool may include a latch-down mechanism and a ram. The plug is lowered through the casing to a desired location, where the setting tool is activated. The setting tool pushes a cone on a mandrel axially, forcing a slip (or two slips if the plug is to hold in both directions) into contact with the inside wall of the casing. A sealing element, normally made from an elastomer, is then pushed radially outward to contact the inside wall of the casing. Increasing fluid pressure differential across the bridge plug normally increases the sealing force. There is a need for a slip assembly that does not damage the inside wall of casing when it is set.

Some bridge plugs are not retrievable because the slips are not designed to release and retract but to be removed by milling or drilling. The slips alone may be milled, releasing the plug to be pushed or pulled along the casing, or in some applications it is desirable to remove the entire plug by drilling or milling it to form cuttings of a size that can be removed from the casing by flow of fluid. The time required to mill or drill a bridge plug from a well is very important, particularly when the bridge plug is used in high-cost operations or when multiple bridge plugs are set in a casing for fracturing multiple intervals along a horizontal section of a well. Therefore, the plug should preferably be made of a material that drills easily. Also, it is often important to remove the plug without damaging the inside wall of the casing. A mill or drill bit may be used to reduce the components of the bridge plug to a size such that they can be circulated from the wellbore by drilling fluid. Since a conventional junk mill will normally damage the inside surface of casing, it is preferable to use a bit, such as a PDC bit, that has a smooth gage surface, to avoid casing damage. In prior art bridge plugs, it has been found that lower components of the bridge plug may no longer engage the mandrel during drilling or milling of the plug, allowing them to spin or rotate within the casing and greatly increase the time required for drilling. Interlocking surfaces at either end of a bridge plug are needed to allow drilling of multiple bridge plugs without rotation. Accordingly, for maximum value, a bridge plug is needed that can be drilled quickly, with a bit that does not damage the surface of casing and that can be stacked for drilling of multiple plugs without rotating.

BRIEF SUMMARY OF THE INVENTION

A slip assembly that can be used to anchor tools or devices at a selected location in a tubular is provided. The slip assembly consists of slips and a cone adapted for moving the slips out radially when the cone moves along slidable surfaces beneath the slips, the slidable surfaces having a selected angle from the axis of movement. The cone and slips are preferably made of easily drillable, ductile material, such as an aluminum alloy. The smooth outside surface of the slips is coated with grit and the slips may include slits and grooves to allow the slips to break into multiple segments during setting. The cone has slits that are narrowed during setting to cause threads inside the cone to become engaged with threads on the mandrel so as to prevent rotation of the cone with respect to a mandrel supporting the slip assembly.

The slip assembly may be employed to anchor a variety of tools inside a tubular, including a bridge plug or frac plug, a cement retainer, a packer or an instrument support. A drillable bridge or frac plug is disclosed including the slip assembly, a drillable mandrel, an elastomeric seal and, optionally, a breakaway segment from the mandrel to form interlocking castles at each end of the plug.

BRIEF DESCRIPTION OF THE SEVERAL VIEWS OF THE DRAWING(S)

The same identification in separate drawings indicates the same part. The axis of all cylindrical parts is not shown, for clarity. Parts are symmetrical around the axis.

FIG. 1(*b*) is an elevation view of the slip assembly.

FIG. 2(*b*) is an elevation view of the slip.

DETAILED DESCRIPTION OF THE INVENTION

Figure 1:
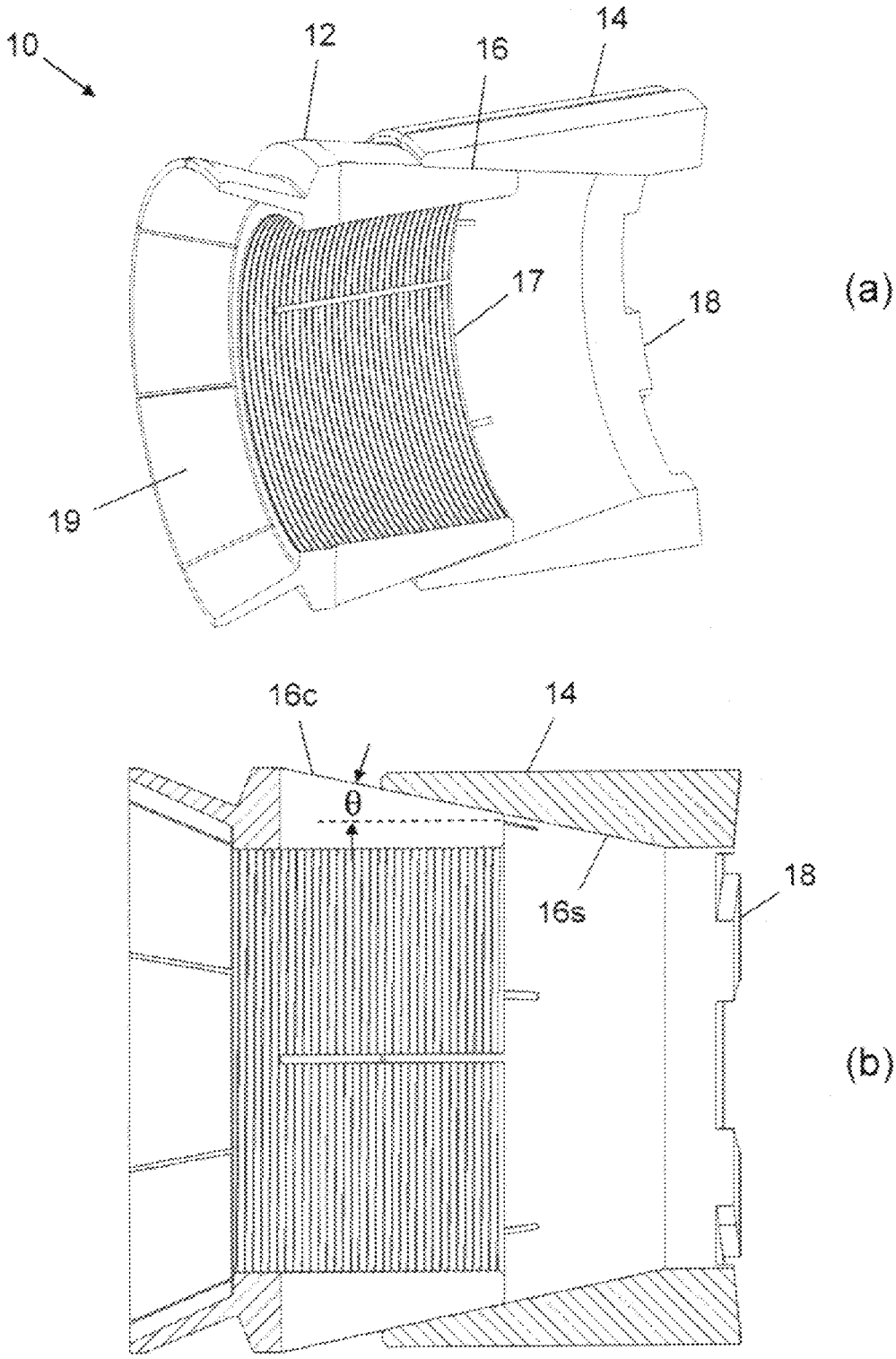
FIG. 1(*a*) is a perspective view of a slip assembly disclosed herein.

Referring to FIG. 1, slip assembly 10 is illustrated by isometric view 1(*a*) and elevation view 1(*b*). Cone 12 may have cup 19 and internal threads 17 for fixing to a mandrel (not shown). When the mandrel moves, slippage at interface

16 between surface 16*c* of the cone and surface 16*s* of the slips causes the slips to expand radially outward. It has been found that angle θ (FIG. 1(*b*)) of surfaces 16*c* and 16*s* with respect to the axis of the cone and slips is preferably between 10 degrees and 22 degrees, and more preferably between 12 degrees and 14 degrees. Slips 14 may have castles 18 at the free end, such that interlocking castles on an adjacent part, such as a mandrel, will prevent rotation of the slip during drilling.

Figure 2:
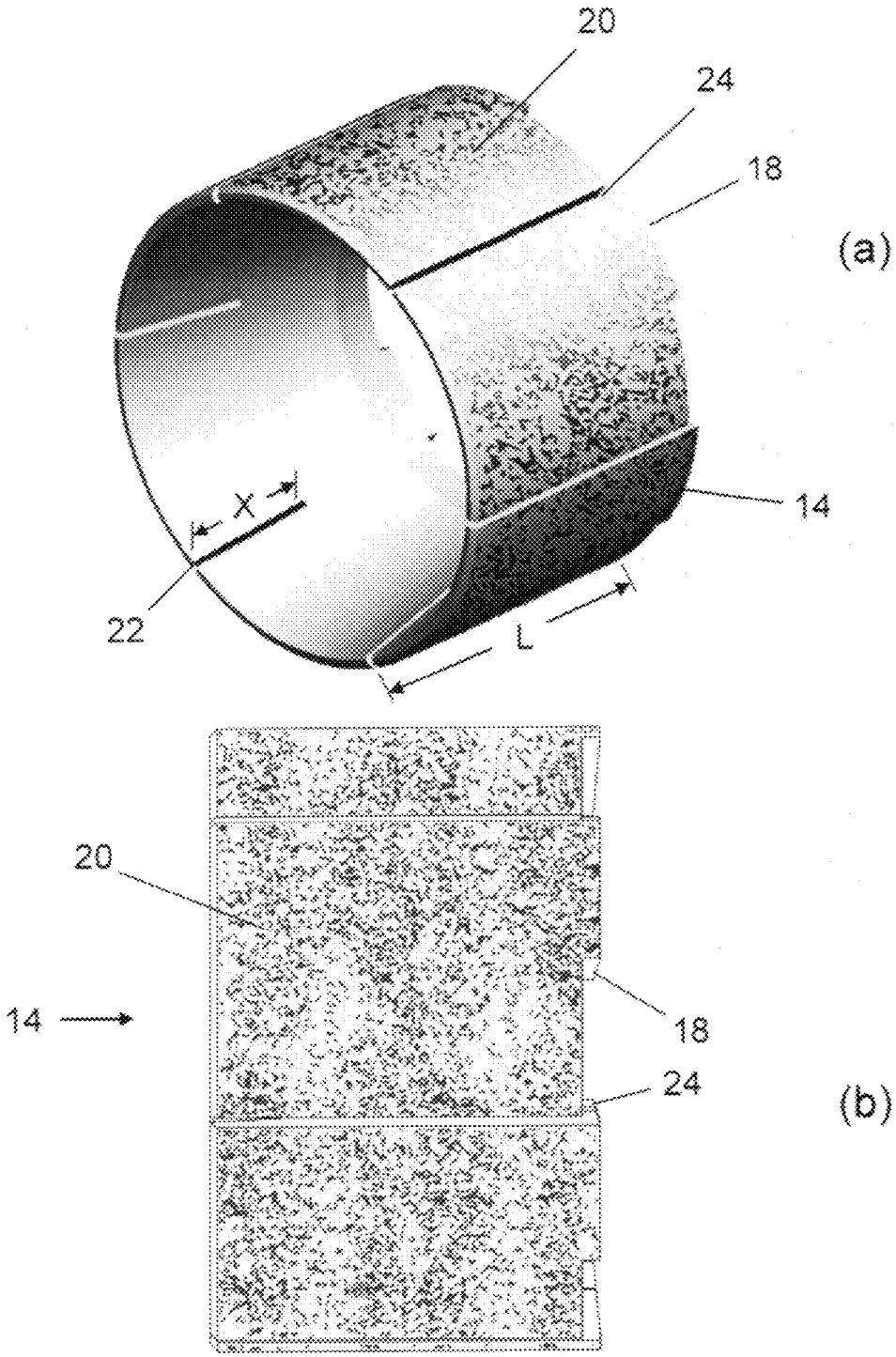
FIG. 2(*a*) is an isometric view of one embodiment of the drillable slip with coating disclosed herein.

Referring to FIGS. 2(*a*) and 2(*b*), slip 14 may have coating 20 on all or part of an outside surface. Coating 20 of slip 14 may be an adherent coating containing a grit, which may be sprayed or otherwise coated on the outside surface. A suitable grit is, for example, made of carbide particles having a size in the range from about 40-400 US mesh (37 microns to 400 microns). A preferred size is in the range of about 100-250 microns. A preferred carbide is tungsten carbide. Other grit that may be used includes a ceramic material containing aluminum, such as fused alumina or sintered bauxite or other fused or sintered high-strength particles in a suitable size range. The grit size is selected so that it will not penetrate a surface enough to create a stress concentration even when a high contact force between the slip and the surface is applied. The grit may be applied to the slip by a plasma spray of metal or other inorganic material that will adhere to the surface of slip 14, or by an organic coating that will adhere to the surface of slip 14, such as an epoxy resin. For an aluminum slip, a plasma spray of nickel alloy is suitable.

The outside surface of slip 14 is preferably shaped to approximately fit against the inside surface of a tubular in which it is to be set. The holding force of the slip (resistance to movement) in contact with casing is determined by the friction between the slip and the casing wall. Therefore, the holding force is bi-directional and rotational. The slip is preferably constructed from a material that can be easily drilled into small cuttings, such as aluminum, an aluminum alloy such as 6061-T6 or 7075-T6, brass, bronze, or an organic or inorganic composite material. All these materials are defined as a "drillable material" herein. Preferably, the material is ductile, so that it can deform enough to contact the inside wall of a tubular with more uniform force over the entire area of the slip. The slips may be made from cast iron; however it is not a preferred material because it is not sufficiently ductile. Slits 22 penetrate through the wall of slip 20 for a selected distance, X, along the slips' axial direction, which is a fraction of the total length, L, of the slip along its axial direction. Groove 24, which partially penetrates the wall of slip for the distance (L−X), is preferably present. As the slip is expanded by a cone, the remaining wall of the slip in the interval (L−X) is fractured under tension. The number of slits and grooves is selected to cause fracturing of the slips into a selected number of segments as the slips are set, normally from three to six segments. As the slips are set, slits in the interval X decrease in width. The width of the slits is adjusted to allow movement of the slips to conform to the inside surface of the tubular where the slips are to be set. Although the use of groove 24 is illustrated here, the groove may not be present and the entire wall of the slip may be fractured under tension as the slips are set. Castles 18 on slip 14 lock with castles on shoulder 43B (FIG. 4) to prevent rotation of the slips during rotary drilling of the slips.

Figure 3:
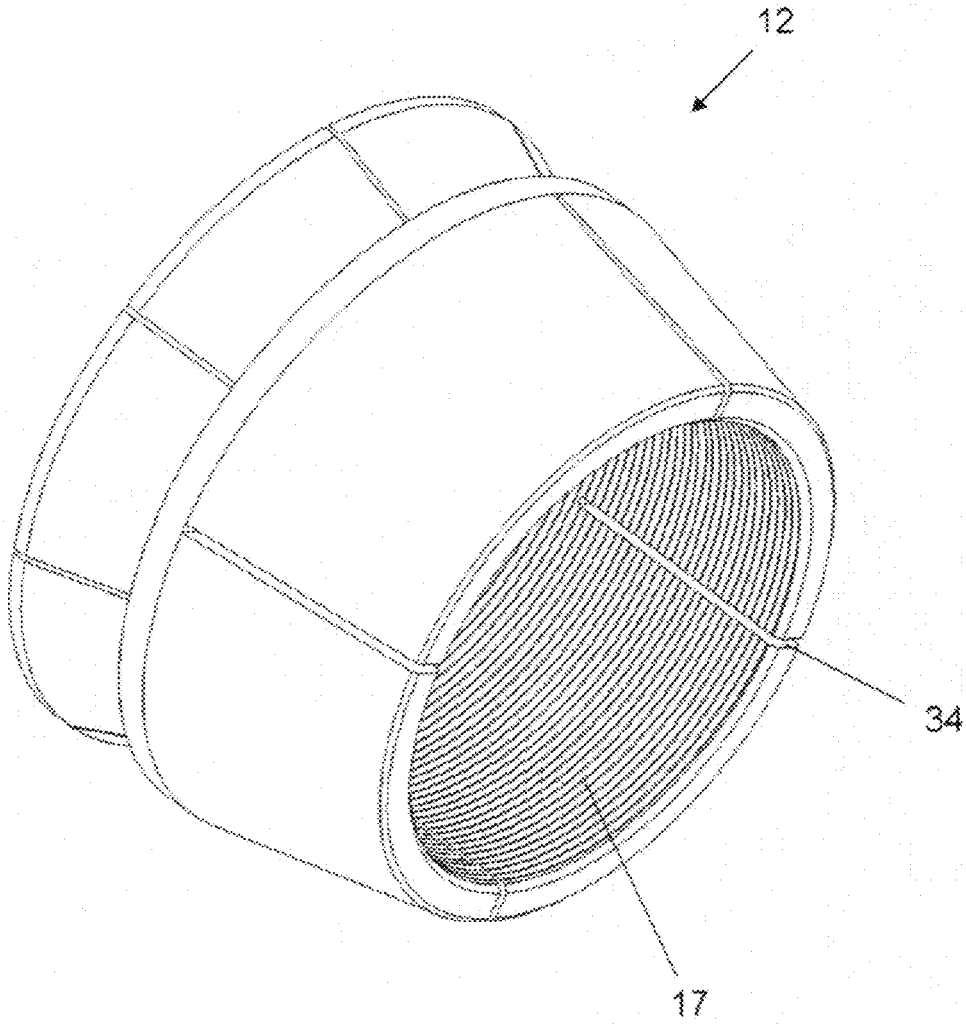
FIG. 3 is an isometric view of the drillable cone.

Referring to FIG. 3, cone 12 preferably contains slits 34. The width of slits 34 is selected such that when cone 12 moves under the slips, slits 34 are narrowed by a compression force directed radially inward. This compression has the effect of disrupting threads 17 that initially matched the threads on a mandrel. With galled threads between the cone and the mandrel that it is attached to, the cone can then be drilled without rotation caused by a drill bit or mill. The cone is preferably constructed from a material that can be easily drilled into small cuttings, such as aluminum, an aluminum alloy such as 6061-T6 or 7075-T6, or an organic or inorganic composite material (i.e., a drillable material). A preferred drillable material is an aluminum alloy.

Figure 4:
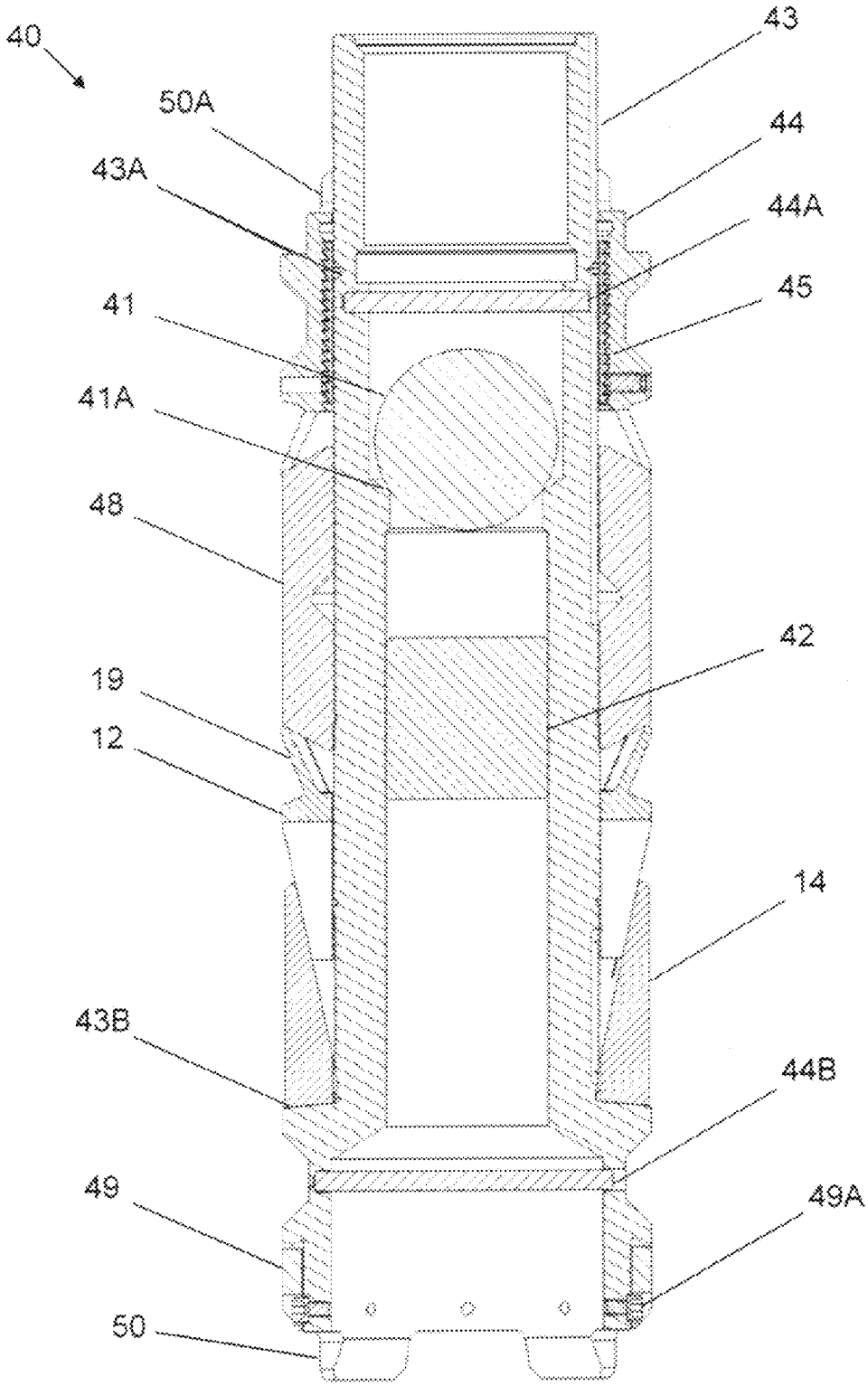
FIG. 4 is a cross-section view of two embodiments of the drillable bridge plug disclosed herein, in which one embodiment (with a ball) functions as a frac plug.

Referring to FIG. 4, two embodiments of a drillable bridge plug 40 are shown. One embodiment is usually called a "frac plug," because it is commonly used to isolate the section of a wellbore below the plug after a hydraulic fracture has been formed in that section. Mandrel 43 is a hollow cylinder. The "plug" of bridge plug 40 is formed when ball 41 is inserted into fluid being injected in a well and seats on seat 41A in mandrel 43. Flow in only one direction is blocked. Ball 41 may be made from a drillable material such as described above. In another embodiment of a bridge plug, plug 42 is put in place in mandrel 43 or mandrel 43 is not hollow, as shown in FIG. 4, before bridge plug 40 is placed in a tubular. Flow in both directions is blocked. Other apparatus may be anchored inside a tubular in a well, such as a cement retainer, a packer or an instrument support using the slip assembly disclosed above on a mandrel.

Drillable bridge plug 40 has mandrel 43, which is preferably made from a drillable material as described above. Mandrel 43 includes shoulder 43B. In bridge plug 40, locking nut 44 is threaded on to mandrel 43. Upper ball retainer pin 44A may be placed in mandrel 43 before locking nut 44 is placed on the mandrel. Ratchet ring 45 is inserted into locking nut 44 before it is attached to the mandrel. Shear screw 44B, which may be made of aluminum and is preferably made of brass, may be inserted into locking nut 44. Shear screw 44B retains the ratchet ring 45 position relative to locking nut 44. It is critical that ratchet ring not thread in or out of the locking ring during these operations, as it would interfere with the ratcheting mechanism. The tool is activated or set by a setting tool as the locking nut is ratcheted down the mandrel. Locking nut 44 is profiled to do two tasks. Free end 50A of locking nut 44 is castled to lock together with the castles 50 on the lower end of the mandrel during a drilling operation. The other end is cupped to contain seal component 48 after it is compressed axially. Upon axial compression, seal component 48 moves radially outward to form a hydraulic seal on the inside surface of a tubular such as a casing. Seal component 48 may be made of nitrile elastomer, preferably having about an 80 durometer, or another suitable elastomeric seal material. Lower ball stop pin 44B may also be inserted into mandrel 43. This would prevent a ball from a lower bridge plug plugging the mandrel. Pump down spacer 49 may be used to allow pumping the bridge plug down a tubular. Pump down spacer 49 may be retained by screws 49A. Castles 50 may be placed on the end of mandrel 43 to prevent rotation of one bridge plug with respect to another bridge plug having castles on the free end 50A of locking nut 44 as stated above. These castles are sized to match with castles 50 on mandrel 43. Interlocking castles prevent rotation of one bridge plug with respect to another bridge plug, making it possible to drill multiple stacked bridge plugs without rotation of the plugs if the bottom bridge plug is set. Notch 43A in mandrel 43 is designed such that upon setting of the bridge plug, the segment of mandrel 43 from the notch to the nearest end of the mandrel may be broken off and brought to the surface of the well with the setting tool. When this segment is removed, matching castles on locking nut 44, on the free end 50A of the bridge plug, are exposed.

Figure 5:
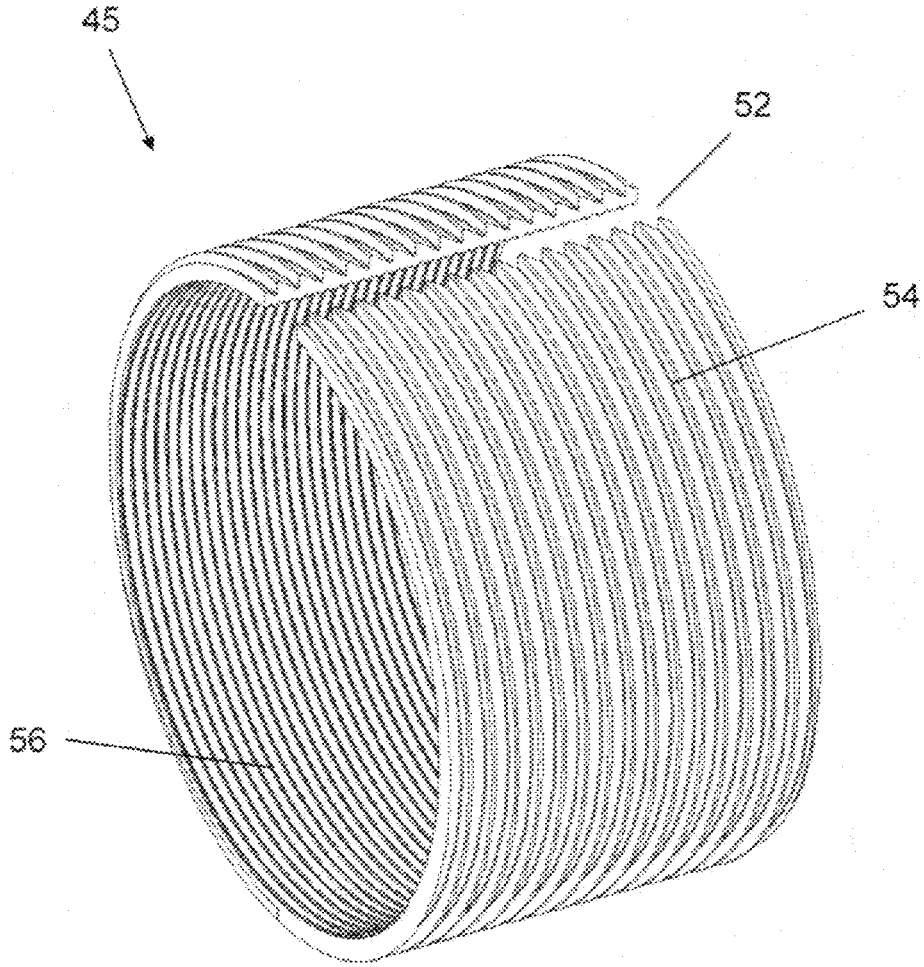
FIG. 5 is an isometric view of a ratchet ring for a drillable bridge plug.

An isometric view of ratchet ring 45 is shown in FIG. 5. The ring has gap 52, allowing compressing the radius of the ring, and outside threads 54 and inside threads 56. The ratchet ring allows the compression of the assembly during the setting process in one direction. As the locking nut is displaced, the teeth push down on the outer teeth of the locking ring and force it down. The inner teeth are shaped and clearanced in a way that allows them to lift up and over the teeth on the mandrel in one direction. Once the locking nut tries to return the other direction the teeth on all parts mesh and hold, preventing the assembly from axial movement. The teeth are also made in a way that tightens the assembly during drill out. This assists in obtaining the maximum amount of material removal before the assembly releases and slides down-hole to the top of the next assembly. The ratchet ring is preferably made from a drillable material such as listed above A PDC (Polycrystalline Diamond Composite) bit or other bit may be used to drill the bridge plugs disclosed herein from a tubular. A PDC bit with a smooth gage surface is preferred, to prevent damage to the surface of the tubular during drilling. The entire bridge plug can be drilled from a casing and the parts circulated to the surface in drilling fluid. The lack of hard metal slips allows use of the PDC bit, which can remove the entire bridge plug in a short time without damaging the inside surface of the tubular, providing a large incentive over use of prior art plugs, especially when rig costs are high. Drilling time for the plug is shorter than that of prior art bridge plugs also since the drill plug is designed for removal of the mandrel segment from notch 43A (FIG. 4) to the nearest end of the mandrel, which can decrease the length of plug to be drilled by about 3 inches. Other drillable materials may be used to construct the bridge plug. The slip being made of a ductile drillable material to conform to the surface of the casing and having a grit avoids the necessity of damaging the inside surface of casing, even at high differential pressure. This is illustrated by the example discussed below.

Although the slip design has been described for application in a bridge plug, it should be understood that a slip comprising a drillable material such as aluminum and with an outside surface conforming to the casing surface and having a grit attached thereto may be used in liner hangers, tubing hangers, cement retainers, storm valves, gage retainers or any other apparatus designed to attach to the inside surface of a well tubular.

EXAMPLE 1

A bridge plug was constructed according to FIG. 4 and the accompanying description. The material of construction for all parts (except the elastomer and the coating on the slips) was an aluminum alloy. The coating was a mix of crushed tungsten carbide 50 mesh particles and nickel alloy powder from Tunco Manufacturing Co. of Flowery Branch, Ga. The coating was sprayed on the surface of the slips using a thermal spray application (plasma).

The bridge plug was tested as per API 11D1. The plug length at assembly was 16.7 inches. The plug with running tool was placed inside a joint of 5½-in casing in an oil bath and the temperature increased to a designated operating temperature of 300 degrees Fahrenheit. The tool was set with a hydraulic setting tool and the setting tool was then removed. The inner mandrel separated at the notch, making the plug assembly approximately 13.6 inches long. A cap was applied to the fixture and pressure above the plug was increased to 10,000 psi and held for 15 minutes. There was no leakage of fluid past the plug. Pressure above the plug was then decreased to 500 psi and pressure was increased below the plug to 10,500 psi and held for 15 minutes. Again there was no leakage of fluid past the plug. Pressure reversal cycles were done again for the above and below with no leakage, bypass, or slippage. The pressure cycles were repeated for pressures of 12,500 psi and 15,000 psi with the same results. The test was repeated for temperatures of 350° F. and 400° F., with the same results.

The plug was then drilled from the casing using a PDC bit with a smooth gage surface. There was no damage to the bit from drilling the plug. Metal cuttings from the bit were examined and found to be minimal in size and shape, which could be circulated from casing using drilling fluid. The time required to drill the bridge plug was 26 minutes. As was expected, the lower mandrel nose dropped and the plug was pushed down by the drill bit on to the top of the next plug once the slips were about 85% drilled.

After the plug was drilled from the casing, the inside surface of the casing was examined. The surface was made rough by very slight impressions where the slip had contacted the surface, but there was no area that would cause increased stress that would lead to a stress failure.

EXAMPLE 2

A frac plug was constructed according to FIG. 4. The material of construction was the same as the bridge plug. The ball was made of an aluminum alloy.

The frac plug length before setting was 16.7 inches. The frac plug with running tool was placed inside a joint of casing in an oil bath and the temperature increased to a designated operating temperature of 300 degrees Fahrenheit. The tool was then set with a hydraulic setting tool and the setting tool was then removed. The mandrel separated at the notch, making the plug assembly approximately 13.6 inches long. A ball was dropped into the fixture and a cap was applied. Pressure above the plug was increased to 10,000 psi and held for 15 minutes. There was no leakage of fluid past the plug. Pressure above the plug was then cycled several times between ambient and 10,000 psi. Each time there was no leakage of fluid past the plug. This process was repeated for 12,500 psi and 15,000 psi and held for 15 minutes each time. Again there was no leakage of fluid past the plug.

The plug was then drilled from the casing using a PDC bit with a smooth gage surface. There was no damage to the bit from drilling the plug. Metal cuttings from the bit were examined and found to be minimal in size and shape, which could be circulated from casing using drilling fluid. The time required to drill the bridge plug was 22 minutes. As was expected, the lower mandrel nose dropped and was pushed down by the drill bit on to the top of the next plug once the slips were about 85% drilled.

After the plug was drilled from the casing, the inside surface of the casing was examined. The surface was made rough by very slight impression in the ID coating where the slip had contacted the surface, but there was no area that would cause increased stress that would lead to a stress failure.

Although the present invention has been described with respect to specific details, it is not intended that such details should be regarded as limitations on the scope of the invention, except to the extent that they are included in the accompanying claims.

We claim:

1. A slip assembly, comprising:

a cone defining an axis and having an outside surface selectively angled relative to the axis, and an inside surface;

a plurality of slips co-aligned with the cone on the axis having an outside surface and an inside surface, the inside surface selectively angled with respect to the axis at the same selected angle as the-cone and adapted to slide over the outside surface of the cone when the cone moves along the axis; and a coating disposed on the outside surface of the slips, the coating containing a grit.

2. The slip assembly of claim 1 wherein the slips are made from a material having greater ductility than the ductility of cast iron.

3. The slip assembly of claim 1 wherein the slips are made from aluminum or an aluminum alloy.

4. The slip assembly of claim 1 wherein the grit is made of a material selected from the group consisting of a carbide or a fused or sintered ceramic containing alumina.

5. The slip assembly of claim 1 wherein the grit has a particle size in the range of 40 to 400 US mesh size.

6. The slip assembly of claim 1 wherein the inside surface of the cone includes threads and a slit through the wall extending a selected distance in an axial direction.

7. The slip assembly of claim 1 wherein the slips are defined by a plurality of slits extending a selected distance in an axial direction.

8. The slip assembly of claim 1 wherein the slips comprise circumferential slips.

9. A bridge plug, comprising:

a mandrel haying threads on an outside surface thereof;

a locking nut adapted to threadably attach to the outside surface of the mandrel;

a ratchet ring disposed between and concentric with the mandrel and the locking nut;

a cone;

an elastomeric seal disposed around the mandrel and between the locking nut and the cone; and a plurality of slips disposed between the cone and to shoulder on the mandrel, the slips having a smooth outside surface and grit disposed on a portion of the smooth outside surface.

10. The bridge plug of claim 9 wherein the mandrel is solid so as to prevent flow therethrough.

11. The bridge plug of claim 9 wherein the Mandrel is a hollow cylinder having a shoulder adapted to receive a ball and adapted to seat the ball to form a plug for flow in one direction.

12. The slip assembly of claim 9 wherein the slips comprise circumferential slips.

13. The bridge plug of claim 9 wherein the mandrel and the locking nut include castles.

14. A method for deploying and removing a plurality of bridge plugs from a tubular in a well, comprising:

attaching a plurality of the bridge plugs of claim 13 on a setting tool;

placing the plugs at a selected locations in the tubular;

setting the plugs and removing a segment of a mandrel of at least one plug with the setting tool to expose the castles of the locking nut; and drilling a least one of the bridge plugs from the tubular using a polycrystalline diamond composite bit.

15. The method of claim 14 wherein the polycrystalline diamond composite bit has a smooth gage surface.

16. A downhole slip apparatus, comprising:

a plurality of slips defining an axis and having an outside surface and an inside surface, at least one of the inside and outside surfaces being selectively angled with respect to the axis; and a coating disposed on the outside surface of the slips, the coating containing a grit.

17. The slip assembly of claim 16 wherein the slips are made from a material having greater ductility than the ductility of cast iron.

18. The slip assembly of claim 16 wherein the grit is made of a material selected from the group consisting of a carbide or a fused or sintered ceramic containing alumina.

19. The slip assembly of claim 16 wherein the grit has a particle size in the range of 40 to 400 US mesh size.

* * * * *

UNITED STATES PATENT AND TRADEMARK OFFICE

CERTIFICATE OF CORRECTION

PATENT NO. : 8,579,024 B2
APPLICATION NO. : 12/836333
DATED : November 12, 2013
INVENTOR(S) : Jason C. Mailand and Glenn A. Bahr It is certified that error appears in the above-identified patent and that said Letters Patent is hereby corrected as shown below:

In the Claims

Column 6, line 66: "an outside surface" should read --a smooth outside surface--.

Column 8, lines 23-24: "an outside surface" should read --a smooth outside surface--.

Signed and Sealed this
Seventh Day of October, 2014

Michelle K. Lee

Michelle K. Lee
*Deputy Director of the United States Patent and Trademark Office*